US006076448A

United States Patent [19]

Rexroad

[11] Patent Number: 6,076,448

[45] Date of Patent: Jun. 20, 2000

[54] METHOD OF USING BARRIER MATERIAL AND SYSTEM

[76] Inventor: John Rexroad, 12 Jackson Rd., Killingworth, Conn. 06419

[21] Appl. No.: 09/012,472

[22] Filed: Jan. 22, 1998

[51] Int. Cl.[7] ..... D04G 1/00; E01F 7/02

[52] U.S. Cl. ..... 87/12; 256/45; 66/195; 442/2; 52/660

[58] Field of Search ..... 87/12, 13, 23; 473/493, 491, 494, 490; 256/37, 40, 44, 45, 32; 182/129; 66/195, 170, 169 R; 139/419; 442/2–3; 52/660, 664; 427/245, 246, 393.5

[56] References Cited

U.S. PATENT DOCUMENTS

| | | | |
|---|---|---|---|
| 203,228 | 9/1878 | Hirst et al. . | |
| 347,029 | 4/1886 | Carver . | |
| 1,700,192 | 1/1929 | Appleyard . | |
| 1,959,574 | 5/1934 | Dunscombe | 273/29 |
| 2,094,919 | 10/1937 | Hughes | 154/44 |
| 2,194,865 | 3/1940 | Mizugoshi | 96/23 |
| 2,407,031 | 9/1946 | Morcaldi D' | 87/11 |
| 2,600,395 | 6/1952 | Domoj et al. | 87/13 |
| 2,659,956 | 11/1953 | Lilienfeld | 28/78 |
| 2,792,617 | 5/1957 | Haller | 28/78 |
| 2,817,263 | 12/1957 | Pedley et al. | 87/13 |
| 2,823,576 | 2/1958 | Needham et al. | 87/1 |
| 2,910,096 | 1/1959 | Frey | 139/419 |
| 2,925,141 | 2/1960 | Frieder et al. . | |
| 3,008,711 | 11/1961 | Dillon | 272/60 |
| 3,039,348 | 6/1962 | Grabowsky et al. | 87/12 |
| 3,047,860 | 7/1962 | Swallow et al. | 343/18 |
| 3,072,512 | 1/1963 | Dalle | 154/46 |
| 3,118,294 | 1/1964 | Laethem | 66/193 |
| 3,170,611 | 2/1965 | Gullen | 224/42.1 |
| 4,000,344 | 12/1976 | Dilbey | 428/255 |
| 4,068,846 | 1/1978 | Forrest | 273/55 B |
| 4,158,985 | 6/1979 | Looker et al. | 87/12 |
| 4,257,309 | 3/1981 | Dunahoo | 87/12 |
| 4,380,327 | 4/1983 | Fish | 256/24 |
| 4,434,200 | 2/1984 | Fash et al. | 428/257 |
| 4,619,108 | 10/1986 | Hotta | 57/236 |
| 4,651,620 | 3/1987 | Lyons | 87/12 |
| 4,805,735 | 2/1989 | Anderson | 182/138 |
| 4,892,210 | 1/1990 | Kupersmit | 220/1.5 |
| 4,895,366 | 1/1990 | Bartasius | 273/29 B |
| 4,948,129 | 8/1990 | Bartasius | 273/29 B |
| 4,986,389 | 1/1991 | Halligan, Sr. et al. | 182/138 |
| 5,011,710 | 4/1991 | Harrison | 427/142 |
| 5,052,686 | 10/1991 | Pryor | 273/29 B |
| 5,134,030 | 7/1992 | Ueda et al. | 428/365 |
| 5,201,497 | 4/1993 | Williams et al. | 256/12.5 |
| 5,225,262 | 7/1993 | Leduc | 428/75 |
| 5,240,769 | 8/1993 | Ueda et al. | 428/365 |
| 5,299,655 | 4/1994 | Margaritis | 182/138 |
| 5,328,310 | 7/1994 | Lockney | 410/97 |

(List continued on next page.)

FOREIGN PATENT DOCUMENTS

| | | | |
|---|---|---|---|
| 879729 | 2/1942 | France . | |
| 879729 | 3/1943 | France . | |
| 203228 | 9/1923 | United Kingdom | 473/FOR 118 |
| 347029 | 4/1931 | United Kingdom | 473/FOR 118 |

OTHER PUBLICATIONS

Navy Drawing May 14, 1987 (1 page).
Pacuda Fun Catalog (11 pages).
Fine Home Building, Jan. 1996 No. 99 (pp. 90–93).
Pacuda Fun catalog 12 pp.

*Primary Examiner*—John J. Calvert
*Assistant Examiner*—Tejash Patel
*Attorney, Agent, or Firm*—Perman & Green, LLP

[57] ABSTRACT

The invention resides in a method of providing a barrier in an environment comprising the steps of providing a structural member which is part of the environment; providing a flexible foam coated fine mesh material capable of being folded on itself and providing said mesh material with a means for securing said mesh material to a structural member in said environment and securing said mesh material through said means to said structural member to provide a barrier between one environment and another.

11 Claims, 16 Drawing Sheets

U.S. PATENT DOCUMENTS

| | | | |
|---|---|---|---|
| 5,344,157 | 9/1994 | McCord | 273/411 |
| 5,393,051 | 2/1995 | Merino et al. | 273/29 B |
| 5,408,770 | 4/1995 | Suzuki | 38/102 |
| 5,433,852 | 7/1995 | Tseng et al. | 427/245 |
| 5,433,991 | 7/1995 | Boyd et al. | 428/193 |
| 5,582,266 | 12/1996 | Rexroad et al. | 182/138 |
| 5,622,094 | 4/1997 | Rexroad | 87/12 |
| 5,752,550 | 5/1998 | Scari'et al. | 139/420 |
| 5,758,868 | 6/1998 | Shen | 256/12.5 |
| 5,771,716 | 6/1998 | Schlussel | 66/195 |
| 5,789,025 | 8/1998 | St. Clair | 427/245 |

METHOD OF USING BARRIER MATERIAL AND SYSTEM

BACKGROUND OF THE INVENTION

The present invention relates to a material used in partitioning children's play areas and industrial guards and relates more particularly to an improvement in such materials and guards whereby the material used is unlikely to unravel, otherwise creating an unsafe condition, undesirable appearance thereby making the play environment or guard more safe and very controlled in its deflection making it highly advantageous for use in industrial guard applications.

The use of playscapes or playground type environments where compartments are filled with plastic balls and slides that deliver children through the environments are becoming increasingly popular especially as found in fast food restaurants. However, it is important to keep certain parts of the playscape confined so that the child does not wander out of it and cause an injury to him or herself. Thus, as between the modular structural pieces of the playscape a barrier is used to make impassable areas of the structure which children should not be moving into. Such further materials have usually been of fishing net type construction and lack durability, softness to the touch as well as any color which would combine with the otherwise colorful array of members in the playscape to make the environment more aesthetically appealing to the child. Also, it has been found that barrier nets have used a simple wire-like plastic mesh which has limited capacity for installation methods and flexibility. However, such single woven material have been known to shred and snag when pulled by a sharp object and thereby lose its shape.

As well, in industrial application wherein large packages and/or equipment is being moved, it is desirable to reduce deflection of the barrier so that travel paths of the packages may not be disrupted. Also, it is desirable to use a material which can withstand and/or prevent unravelling as packages are moved along a delivery system. Even still, in the industrial guard application, it is desirable to use a mesh material which is collapsible on itself when it is necessary for the mesh to be retracted and material that allow various sizes and shapes to be fabricated to reduce sag and provide more accurate tolerances.

Accordingly, it is an object of the invention to provide a barrier mesh structure of the aforementioned type wherein the material making up the netting is structurally resistant to shredding when pulled or snagged by a sharp object such as would be found in the context of industrial guards and child play areas.

Yet a further object of the invention is to provide a material of the aforementioned type which is capable of having a given color which is coordinated with the color scheme of a given playscape or industrial/commercial seams.

Still a further object of the invention is to provide a barrier material which is used for children in a playscape and which material has a mesh construction that is small enough to prohibit climbing by an individual.

Further objects and advantages of the present invention will become apparent from the following disclosure and appended claims.

SUMMARY OF THE INVENTION

Figure 2A:
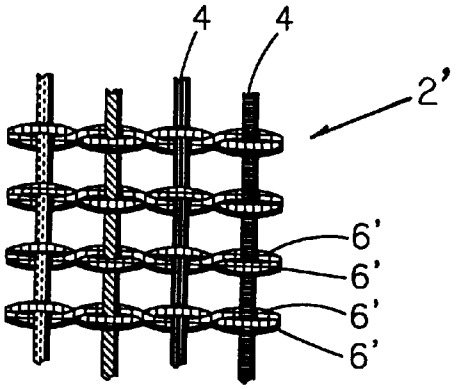
FIG. 2*a* is a partially fragmentary plan view of a leno weave shown in FIG. 1 with a multicolor design.

The invention resides in a method of providing a barrier in an environment comprising the steps of providing a structural member which is part of the environment; providing a flexible foam coated fine mesh material capable of being folded on itself and providing the mesh material with a means for securing the mesh material to a structural member in the environment and securing the mesh material through the means to the structural member to provide a barrier between one environment and another.

Desirably, the method is characterized by providing the mesh as a leno weave and with a flexible foam PVC coating.

In one embodiment the method includes providing the leno weave with a polyester yarn running in a vertical direction and two polyester yarns running in a horizontal direction wherein the denier of the polyester yarn running in the vertical direction is twice that of the yarn running in the horizontal direction. alternatively, two yarns running in the horizontal direction may be provided having a color which is different from those yarns running in a vertical direction, or the yarn running in a vertical direction may be provided with a color different from each of the colors of the two yarns running in the horizontal direction.

Alternative the method may be practiced by providing a mesh being a basket-weave pattern.

Desirably the method is characterized by providing a border member and holding a portion of the mesh having at the leading edge thereof over the border member and sewing the leading edge to the border member, or by providing the means for securement of the mesh to a structure as a pocket webbing in securing the pocket webbing to the mesh through a longitudinal serger stitch.

The invention also resides in a method of forming a barrier partitioning one area from the other comprising the steps of providing at least one structural member in an area for supporting a barrier mesh therein; providing a mesh comprised of a plurality of closed shapes each comprised by a length of cord connected to a juxtaposed length of cord at given nodal points; providing each the lengths of cord as a lock woven mesh cord wherein the lock woven mesh cord is formed by weaving two pillars of cord in side by side lock together manner; attaching the mesh to a means and connecting the mesh to the means to the structural member to provide a barrier between one area and another.

The method is further characterized by the lock woven mesh being formed in a diamond pattern and cutting the mesh diamond pattern in a diagonal fashion so as to create a square mesh pattern and by providing an upper webbing and sewing the mesh at the leading edge thereof to the webbing and inserting within the upper webbing a support cable.

Ideally, the method is further characterized by providing a lower pocket webbing at the lower end of the mesh and securing it to the lower end of the mesh via a sewn stitch and inserting within the lower pocket webbing a weight or chain for pulling the mesh tautly between the support cable and the chain and by providing the upper pocket webbing with at least one grommet and supporting the mesh structure using the grommet. Also possible are top and side borders with other options, such as sewn cord.

Desirably, the method is further characterized by providing a right angle connection between two structural members and connecting at least one edge of the mesh to an associated structural member using a tie wrap or lashing cord and by providing a right angle connection between two structural members and connecting at least one edge of the mesh to an associated one of the structural members using a lashing or tie wrap.

In one embodiment, the method is further characterized by using the mesh in a diamond configuration and threading a border rope through endmost ones of nodes defining the mesh and attaching at least one of the endmost nodes to the border rope using a flexible C ring fastener and by connecting the border rope to a structural member via a locking hook or a doubled back length of the border rope.

The invention further resides in a system for creating a slidable barrier in amusement and industrial settings comprising a generally horizontally disposed structural member located generally in a plane with at least two vertically oriented and spaced anchor points. A mesh is provided having a upper border member and a lateral border member. The upper border member having a plurality of hook rings which are passed through the upper border member and connect the around the horizontally disposed structural member; the lateral side edge border having a means for securing same between the two vertically spaced anchor points such that the lateral side edges of the mesh are constrained against the movement and the horizontally disposed border can be retracted horizontally thereto.

While discussed in terms of horizontal and vertical above, the orientation of the structural members can be changed such that the anchor points are horizontally oriented and the slidable barrier slides vertically rather than horizontally.

Ideally, the hook members being passed through grommets in the upper horizontally extending border member and the lateral border member being a hollow pocket webbing through which a rope is passed and secures between the two anchor points disposed in vertical alignment with one another. Alternatively, the hook members can be passed through the mesh directly through a cord border.

The invention resides still further in a system comprising a structural member, a hollow border member, a support rod disposed within the hollow border member, and a mesh having at least one panel with a connection line connecting the hollow border member to the mesh. The border member having at least one cutout formed therein with forming a spacing between the support rod and the one edge of the at least one cut out. A securement means is provided for connecting the support rod to the structural member, the securement means passing around the structural member and through the at least one cutout.

DETAILED DESCRIPTION OF THE PREFERRED EMBODIMENT

Figure 1:
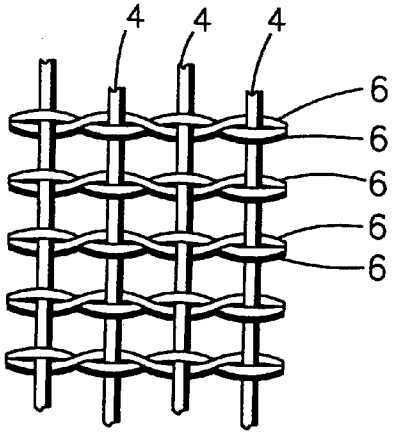
FIG. 1 is a partially fragmentary plan view of a coated yarn leno weave.

Referring to FIG. 1 the weave illustrated generally as two is disclosed for use in a new and unobvious application for a barrier material in a play area or used in industrial guards. A playscape is generally defined as a play area set aside usually in a fast food chain restaurant or in an amusement park where children engage in sliding down a structure and into, for example, a pool of plastic balls. With such a structure it is important to enclose certain areas against child access out of the area and for example onto a hard pavement below. It may also be necessary to restrict the ability of a child to climb up on such barrier material in order to impede vertical movement. The mesh 2 is illustrated is a leno weave as is well understood in the industry and in the preferred embodiment and is comprised of yarn of 1,000 denier polyester running a vertical direction as illustrated by elements 4,4 and two 500 denier yarns 6,6 running in a horizontal direction. The yarns are coated by using a highly flexible foam PVC. It is the coating of the yarns 4,4 and 6,6 which allows the material to be highly supple and flexible and soft to the touch. Also, the coating provides for excellent wear and is easily fabricated as well as being excellently fire retardant to performance. The below Table 1 illustrates the specific characteristics of one type of material. Also, in the preferred embodiment, the material 2 is commercially readily available and is sold in a variety of products which can be purchased. One such product is sold by BO-Tex Sales Corporation, 175 Industrial Road, Hogansville, Ga. 80250, under part number BO-LOC7X5 and is described in Table A below.

TABLE A

| | |
|---|---|
| Construction: | 7 × 5 ends/inch |
| Coating: | Flexible Foamed PVC |
| Core Yarn: | 100 denier Polyester |
| Fabric Weight: | 6.5–7.5 oz/sq. yd. |
| Tensile Strength: (ASTM D-2261) | 45 lbs. minimum warp |
| Tongue-single rip | 35 lbs. minimum fill |
| Mullen Burst Strength: (ASTM D-3786) | 257 lbs/sq in minimum |
| Fire Retardancy: | Afterflame: Less than 3 seconds (typical) |
| (Fed. Std. 191, Method 5903.2, Vertical) | Char Length: Less than 4 inches (typical) |
| Cold Crack: | No cracking after 24 hours @ −40° F., 2" mandrel |
| UV Resistance: (ASTM G53) | 1000 hours QUV exposure-slight color deterioration (Not applicable for fluorescent colors) |
| Specific Gravity: | 0.60 |

As illustrated in FIG. 2*a,* the mesh material 2' may further be made more aesthetically pleasing to the environment in which it is used by causing each of the yarn 6,6' to be colored differently while the vertically extending yarns 4,4 may be colored differently from the other horizontally disposed yarns 6',6'. Also, as illustrated in FIG. 7*b,* a length of webbing may be attached to a length of the material 2,2' via a sewn intersection 8 for allowing the mesh to be secured to a structure as will be discussed in greater detail later.

Figure 2B:
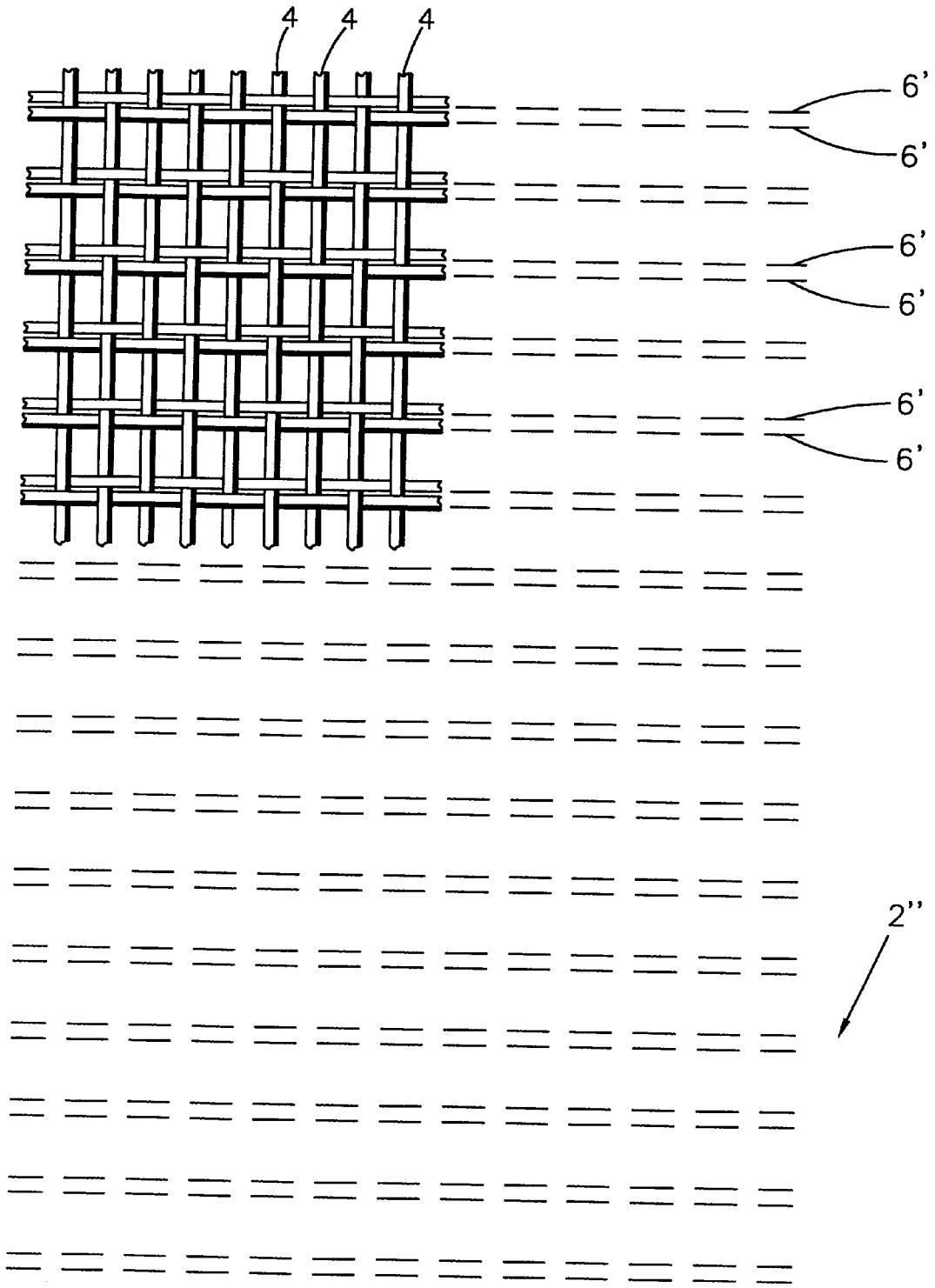
FIG. 2*b* is a partially fragmentary plan view of an alternate weave.

As seen in FIG. 2B, the barrier material 2" employed by the present invention may take the form of a fine mesh which is coated not by foamed plastic but in stead by other materials, such as, VINYL or ARLYN. The material shown in FIG. 2*b* is commercially sold by PHIFER Wire Products, Inc., P.O. Box 1700 Tuscaloosa, Ala. 35403, as a color fast 10×7 mesh, 0.025 mil plain weave. The yarns, e.g. warp and fill, are each of the same 0.025" diameter and are made from polyester fabric coated with vinyl. Alternatively, the invention can be equally successfully practiced using an ARLYN coated polyester fabric, with a 4×4 grid having a 28 mil yarn, also sold by PHIFER Wire Products, Inc.

Figure 3B:
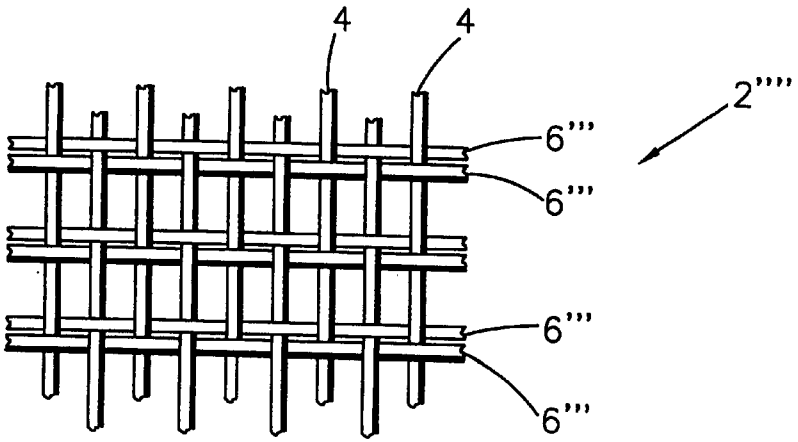
FIG. 3*b* is a partially fragmentary view of a basket weave pattern.
Figure 3A:
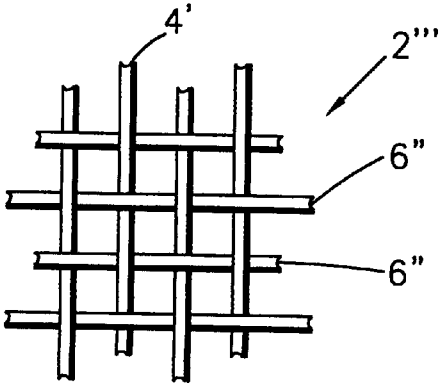
FIG. 3*a* is a partially fragmentary view of the over under weave pattern.

Referring now to FIGS. 3*a* and 3*b* it should be seen that the mesh 2'", 2"" may further take the form of a basket-weave pattern with the vertically extending yarns 4,4 intersecting with the horizontally disposed yarn 6,6 in an over/under configuration. While shown in a one-to-one corresponding pattern in FIG. 3*a,* it should be understood that the invention may be practiced by a 2-1 or 3-2 type over/under corresponding relationship between vertical and horizontal extending yarns as shown in FIG. 3*b.*

Figure 4:
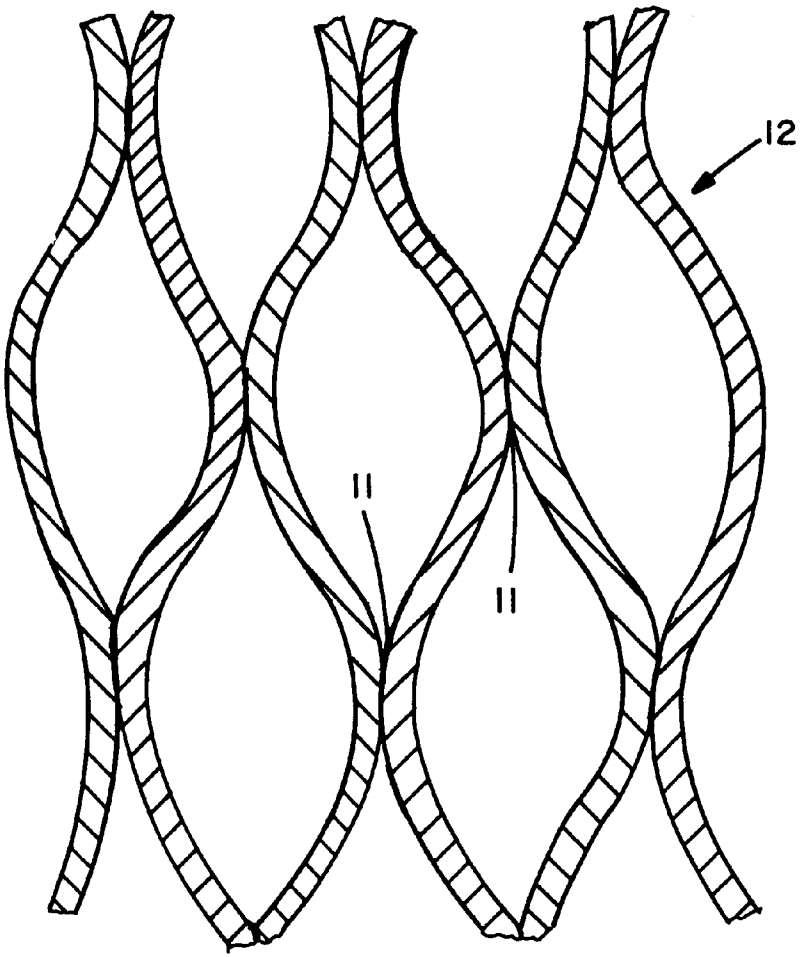
FIG. 4 is a partially fragmentary plan view of a lock woven mesh.

Referring now to FIG. 4, and to an alternative embodiment of the mesh structure shown in FIGS. 1–3, it should be seen that the mesh structure shown in FIG. 4 is a mesh which is capable of allowing enhanced ventilation and viability of the individual or object within the enclosed environment. That is, depending upon the type of application, the mesh disclosed in FIGS. 1–3 can be used where a nonclimbing environment is to be used or a more enclosed appearance is desired, whereas the mesh of FIGS. 4 and 5 can be used where greater visibility is desired.

Figure 6:
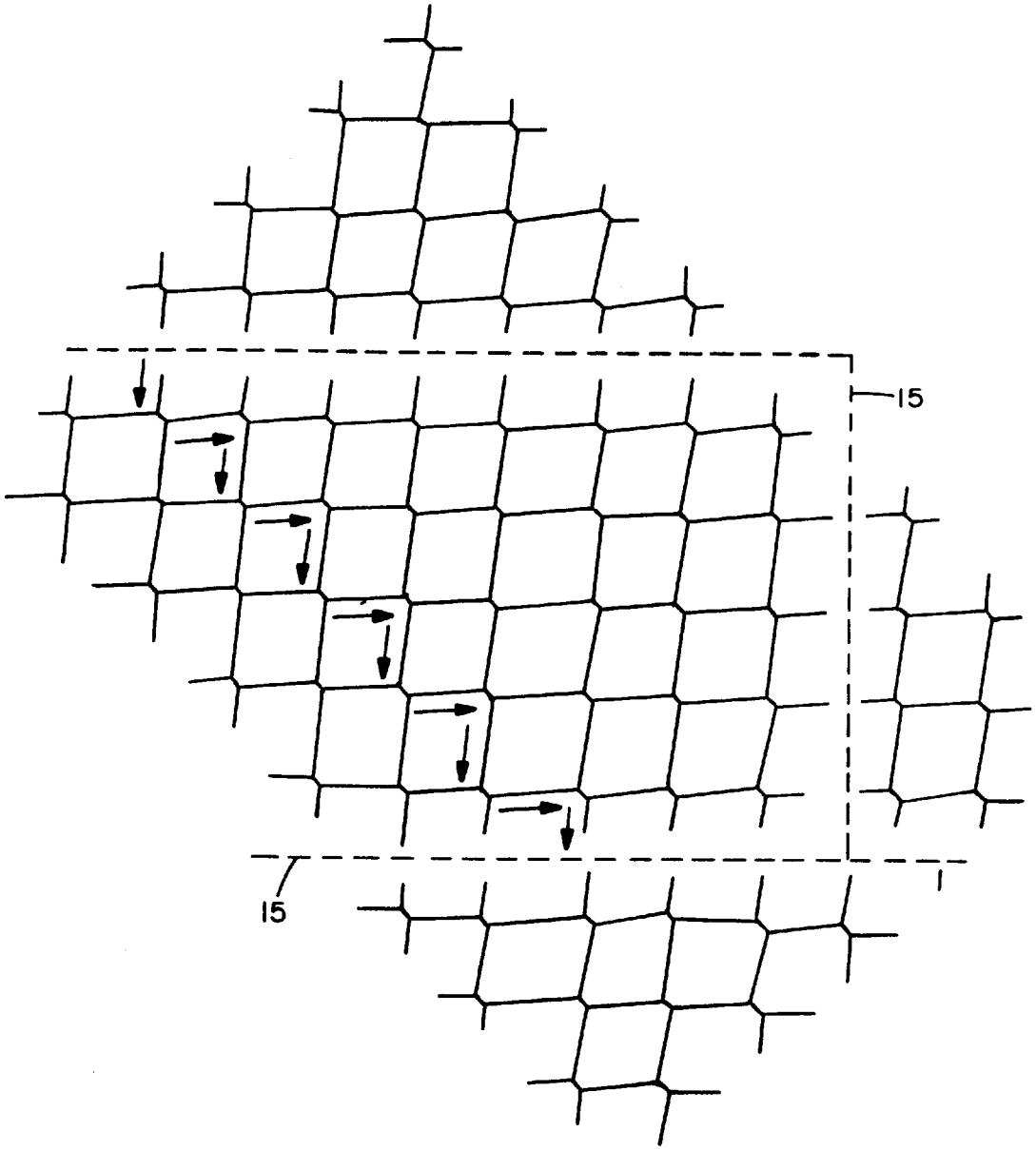
FIG. 6 is a plan view illustrating the cutting pattern of an otherwise diamond shape lock woven mesh cut to form a square shape configuration.

The mesh structure illustrated in FIG. 4 and referred generally as element 12 is a lock woven mesh. A lock woven mesh is meant that the mesh is comprised of two pillars woven together and which two pillar members are caused to intersect and connect to one another at nodes 11,11 in a manner that greatly reduces and/or eliminates the unravelling of the mesh. In the example shown, the mesh is 4¼ stretch mesh thus creating an intersection of the braid to create a diamond pattern. As illustrated in FIG. 6, the mesh can be cut in a diagonal fashion along lines 15,15 so as to create a square mesh pattern which is readily applicable in a square arrangement, such as shown in FIGS. 7*a,* 8*a,* 9*a,* 10*a* and 11*a.*

The two pillar construction is in fact a flat construction when seen in the side view thereby allowing a thicker or heavier footprint to be made by the twin pillar construction for better partitioning effect and stability. The process by which the twin pillar construction is affected by the additional use of a bar in the weaving process such that the opposing bars are locked together. The lock woven mesh is readily commercially available as sold by TEK-Knit Industries, 521 Boul. Lebeau Boulevard, St-Laurenent, Quebec, H4N 1S2, Canada. The mesh as sold commercially is of a diamond-shaped construction and is rotated 45° from its otherwise diagonal shape whereupon as shown in FIG. 6. As will be discussed in further detail later with reference to FIG. 7*a,* the cut mesh is sewn such that the leading edge of the mesh strand is aligned in a straight pattern with the rope and a sewing 8 made thereto.

Figure 5:
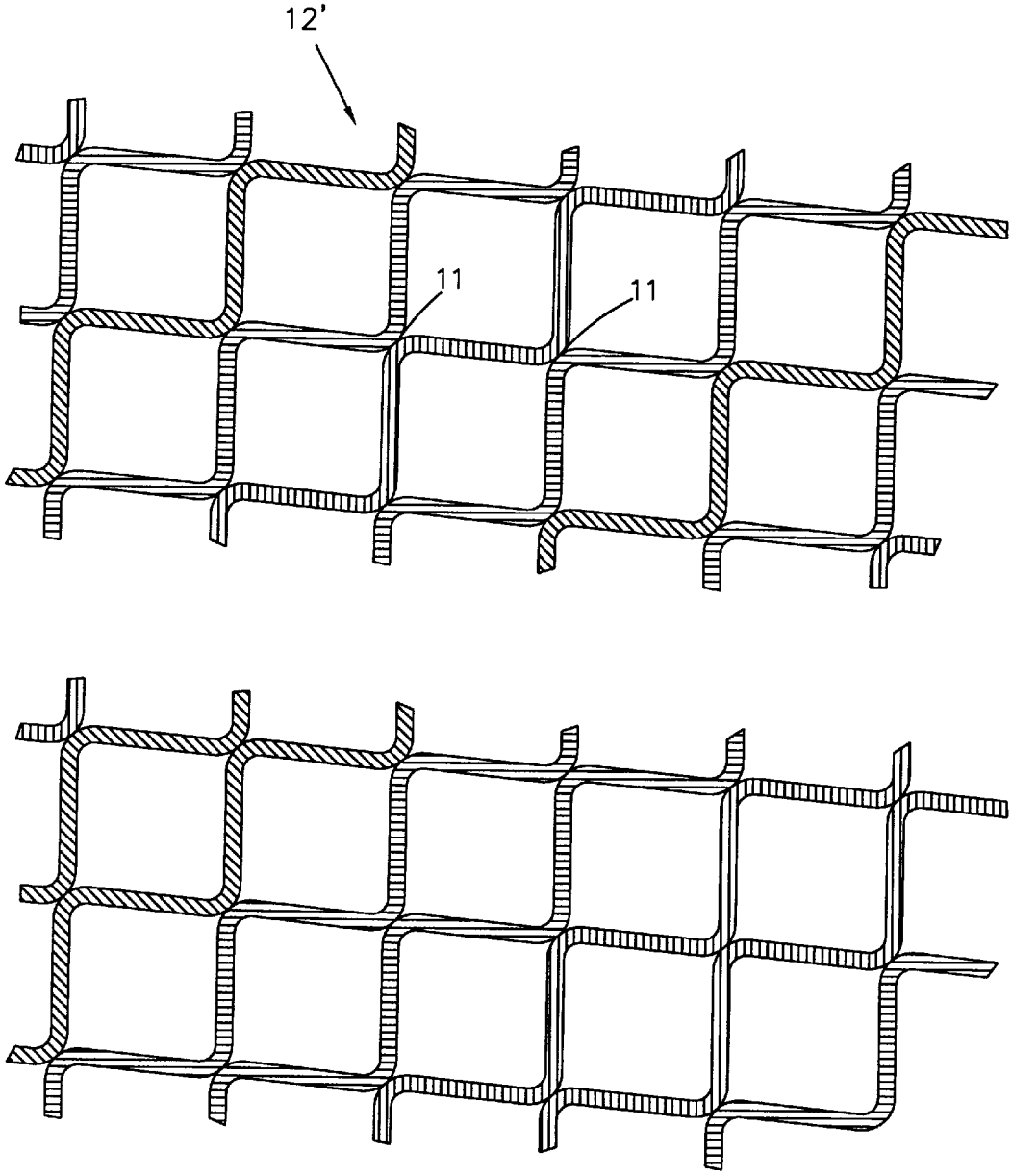
FIG. 5 is a partially fragmentary plan view of a multicolor lock woven mesh.

Referring now to FIG. 5, it should be seen that each of the cords of the mesh 12' may be given a different color such that the intersections at every 4¼ inches creating a diamond pattern can create a "lightning bolt" type of color array for a given color pattern. That is, the bipillar cords intersect and are interwoven as such locations 11 which define nodal points of the mesh. By weaving each cord in a different color the mesh becomes a multicolored design thereby leading to a aesthetically pleasing variant of color pattern that is workable with a given playscape configuration.

Figure 7A:
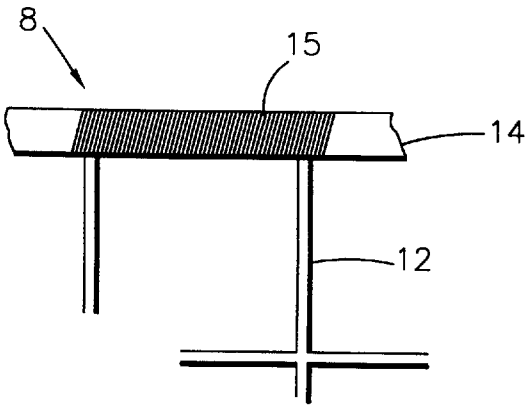
FIG. 7*a* is a partially fragmentary elevation view showing a cord or rope sewn to a mesh for securement purposes.
Figure 7B:
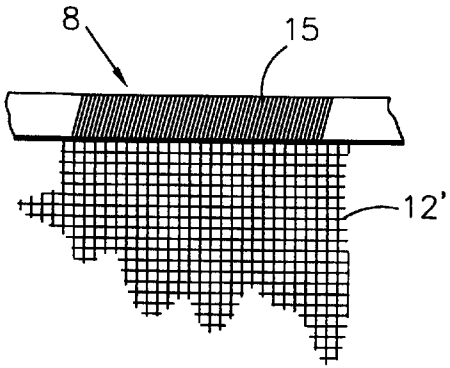
FIG. 7*b* is a partially fragmentary elevation view showing a cord or rope sewn to an improved viability and increased ventilation mesh for securement purposes.

Referring now to FIGS. 7*a* and 7*b,* it should be seen that a border construction is shown wherein a rope or cord 14 can be used as a border support to which the mesh 12 is attached via a serger stitch 15. As seen, the mesh 12, 12' can take the form of either the improved viability and increased ventilation mesh shown in FIGS. 1, 2 and 3 or the mesh 12' shown in FIGS. 4 and 5.

Figure 8A:
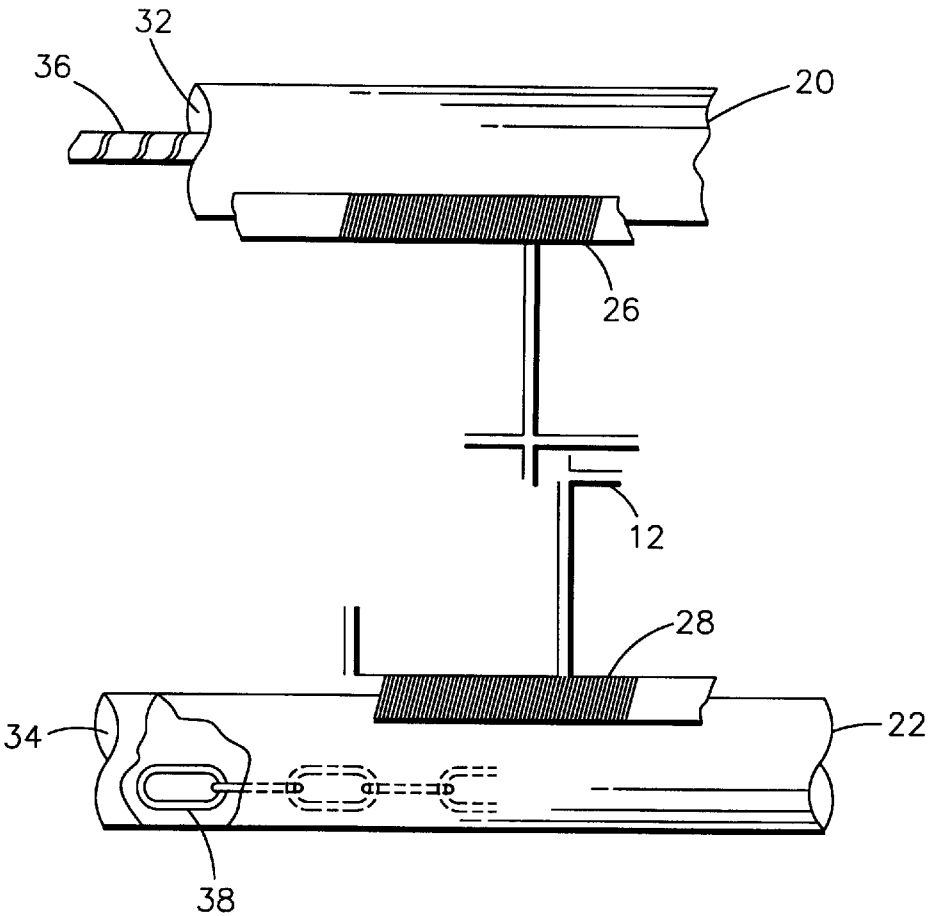
FIG. 8*a* is a partially fragmentary view showing of a pocket webbing sewn to a mesh to allow a cable rod or rope chain to pass therethrough for securing the mesh to a structure.
Figure 8B:
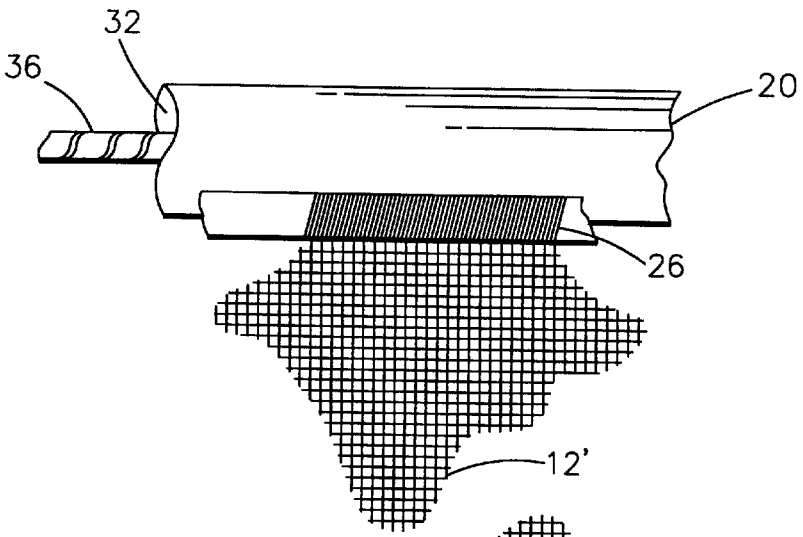
FIG. 8*b* is a showing of a pocket webbing sewn to a improved viability and increased ventilation mesh to allow a cable rod or rope chain to pass therethrough for securing the mesh to a structure.
Figure 16:
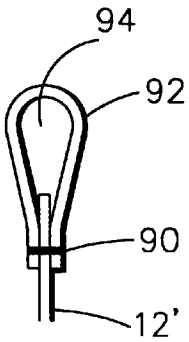
FIG. 16 shows an end view of a single mesh panel connected to a border member with flat webbing folded over and sewn to create a pocket.

Referring now to FIGS. 8*a* and 8*b,* it should be seen that the mesh construction 12, 12' in this embodiment is connectable to pocket webbing 20 and 22, respectively, which is attached to the upper and lower edges of the mesh through respective sewing attachments 26 and 28. The pockets 20 and 22 are tubular members which are sewn along their bottom length to a length of mesh. Alternatively, each pocket member can be formed from a doubled over length of webbing which is sewn together with the connected length of mesh along sewing attachment points 26 and 28 (similar to the configuration illustrated in FIG. 16). The sewing 26 and 28 is a lengthwise connection using a stitch which is well known in the industry as a serger stitch.

Figure 8B:
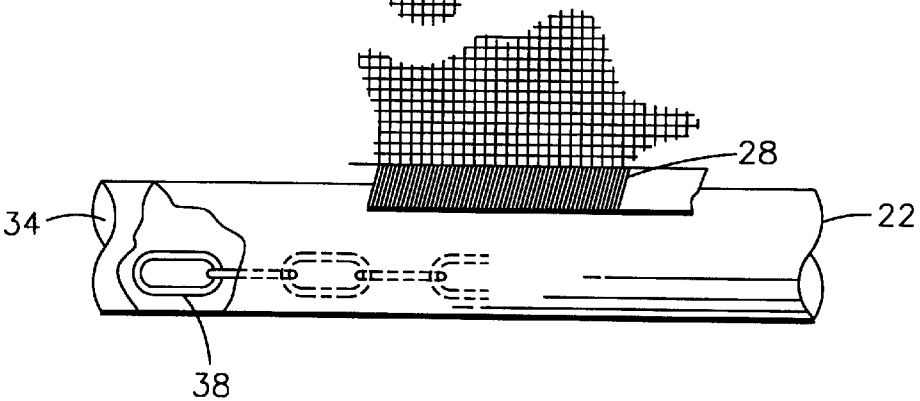

Each pocket 20, 22 has an internal chamber 32, 34 into which an appropriate structural member is received. In the case of the upper pocket 22, a support cable 36 is received within the opening 32, while in the case of the lower pocket 22, a chain or similar weighted material 38 is placed. In this way, the mesh 12, 12' will be pulled tautly, vertically, downwardly from the support cable 36 at the upper end. It should, however, be understood that while the mesh structure 12 shown in FIGS. 8*a* and 8*b* can be a multicolored mesh as illustrated in FIG. 5, the mesh 12 shown in FIGS. 7–9, and that shown in FIG. 6, noting of course that mesh 12 can take the form of either the improved viability and increased ventilation mesh shown in FIGS. 1, 2 and 3 and the mesh 12' is that shown in FIGS. 4 and 5.

Figure 9A:
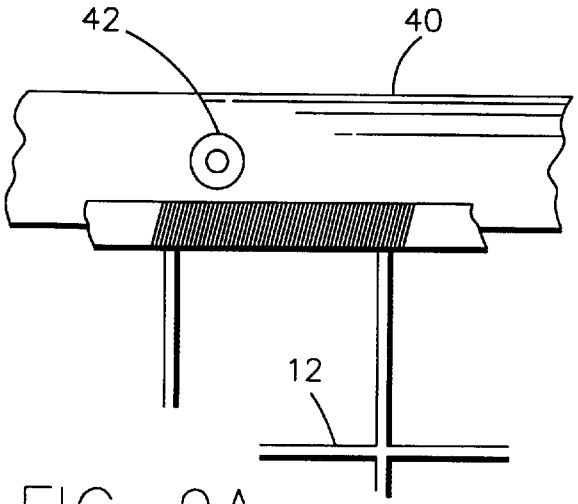
FIG. 9*a* shows a webbing with grommets for securement to a structure.
Figure 9B:
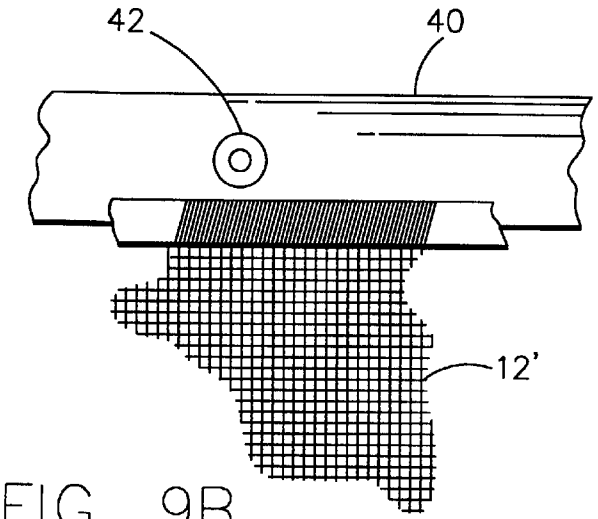
FIG. 9*b* shows a improved viability and increased ventilation webbing with grommets for securement to a structure.

Referring now to FIGS. 9*a* and 9*b,* it should be seen that the flat webbing shown therein as element 40 is provided with a plurality of grommets 42,42 which serve as anchorage points for the webbing 40 to be supported such as by hooks on the structural member. As mentioned earlier, depending upon the type of application, the mesh identified as 12 in FIG. 9*a* is that which is disclosed in FIGS. 1–3 and is used where a nonclimbing environment or more enclosed appearance is desired, or the mesh identified as 12' in FIG. 9*b* is that disclosed in FIGS. 4 and 5 can be used where a more visible and open environment is desired.

Figure 10A:
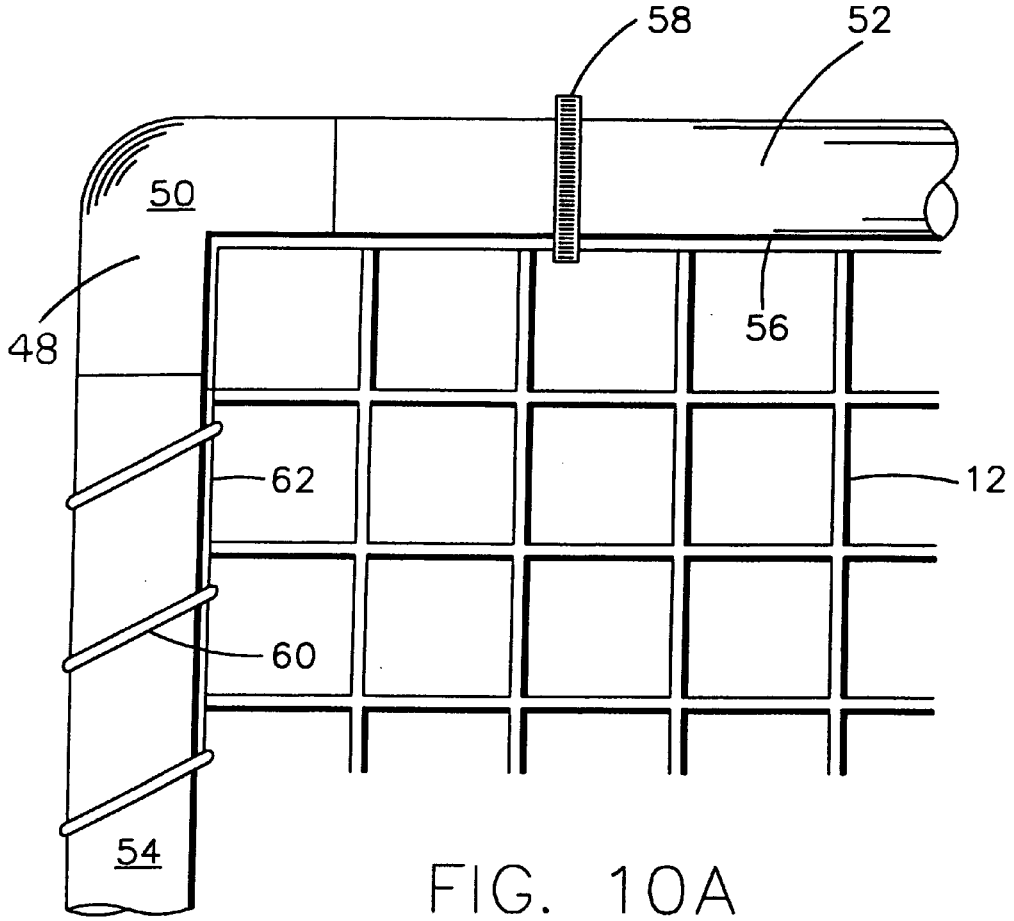
FIG. 10*a* illustrates a mesh attached to a frame structure by tie wrap and by lashing.
Figure 10B:
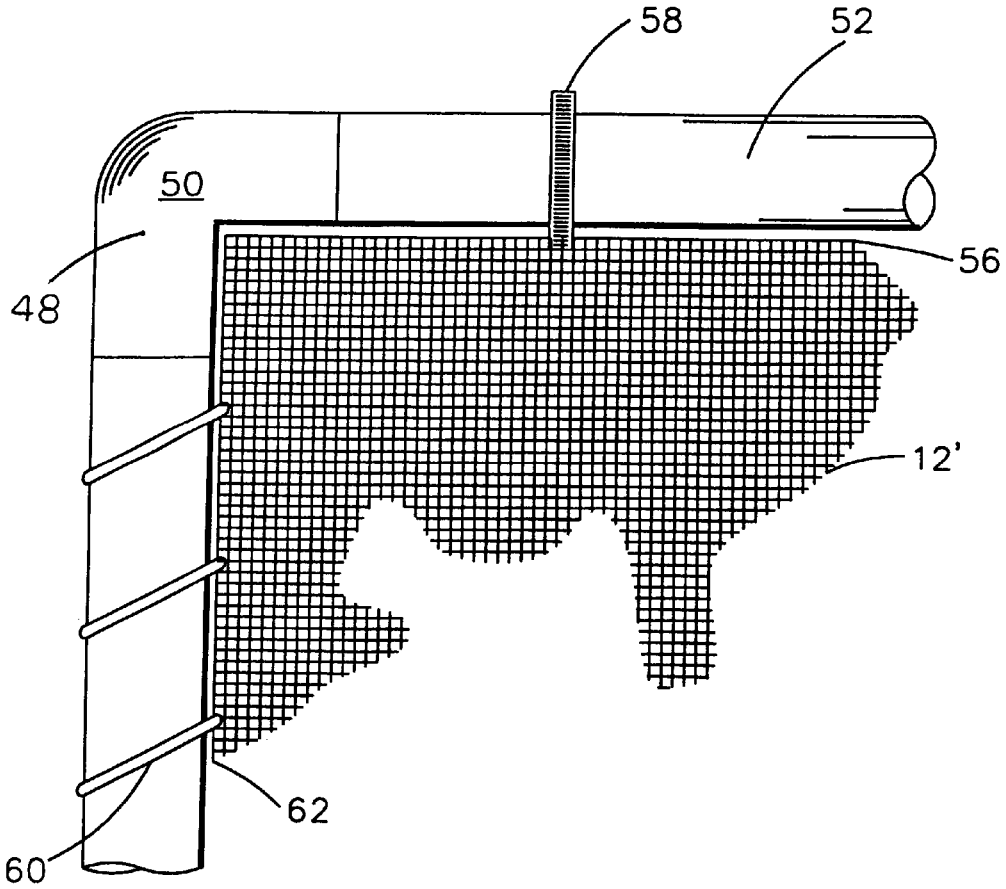
FIG. 10*b* illustrates a improved viability and increased ventilation mesh attached to a frame structure by tie wrap and by lashing.

Referring now to FIGS. 10*a* and 10*b,* it should be seen that a right angle structural connection shown generally as 48 and is comprised of an elbow joint 50 with inserted tubular members 52 and 54 connected thereto. As illustrated, either of the meshes 12, 12' can be attached via its upper horizontal run 56 through a tie wrap 58 which is caused to clamp around the member 52, or alternatively, as shown in the vertically disposed structural member 54, to a spiral lash 60 which may be used to secure the left-most run 62 of the mesh 12,12' to the structural member 54.

Figure 11:
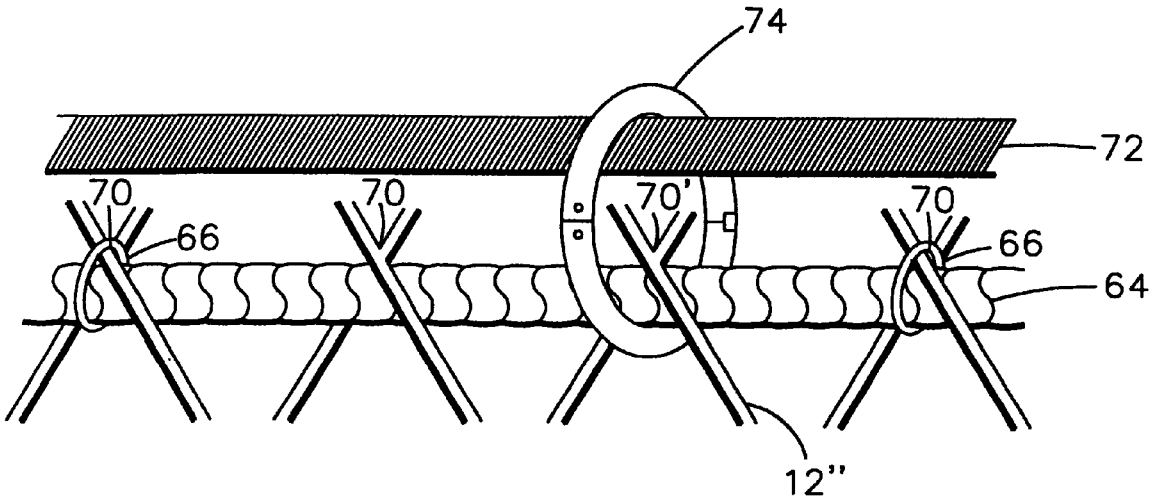
FIG. 11 illustrates an attachment of a border rope to a mesh with a flexible C rings with the border rope being then hung to cables via hooks or clips.

Referring now to FIG. 11, it should be seen that mesh 12", may be connected to an intermediary border member 64 to the intermediary of flexible C ring connections 66,66. The mesh 12" is of the type which is in its unaltered commercially available state wherein the diamond pattern is left uncut (as discussed by the method of FIG. 6.) The flexible C ring connections used are those disclosed in U.S. Pat. No. 5,582,266 issued to Rexroad et al. and entitled "Safety/Debris Net System" and which patent is hereby incorporated by reference. The rings 66 are readily commercially available and sold Stanley Inc. under part No. 15G100P and are applied via a commercially available tool sold under the tradename Spenax under model no. SC4C and part no. TLSCSC4C.

As illustrated, the mesh 12" in the embodiment shown in FIG. 11 is specifically oriented in its diamond orientation to accommodate the border rope 64 thread through the leading nodal points 70,70 such that alternative ones of the nodes 70,70 need only be affixed by a C-ring connection 66,66. As between the border rope 64 and a support member herein illustrated in element 72, a fastening hook 74 is provided and connects between a nodal point 70' and the structural member 72. As illustrated, the placement of the fastening hook 74 is made preferably at a node point where the mesh is only threaded through the border rope and no C-ring is present. It is noted that it is preferable to use a mesh 12" which is of a diagonal design, but it is well within the purview of the invention to use a square configuration, such as shown in FIGS. 7*a,* 8*a* and 9*a,* or to use a fine mesh of the type shown in FIGS. 1–3.

Figure 12A:
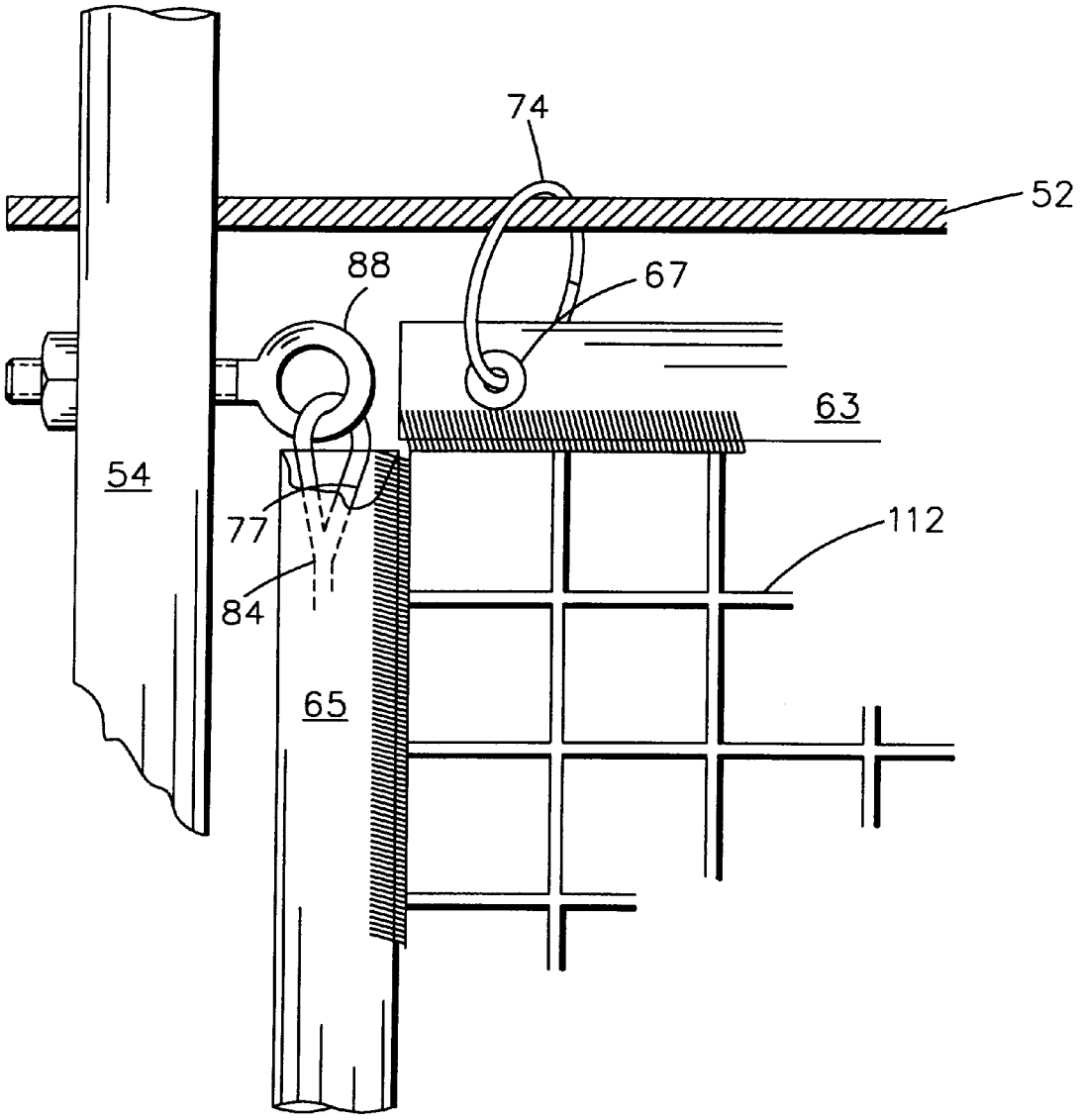
FIG. 12*a* illustrates a retractable improved viability and increased ventilation barrier using flexible borders and top border attached to cables with hooks.
Figure 12B:
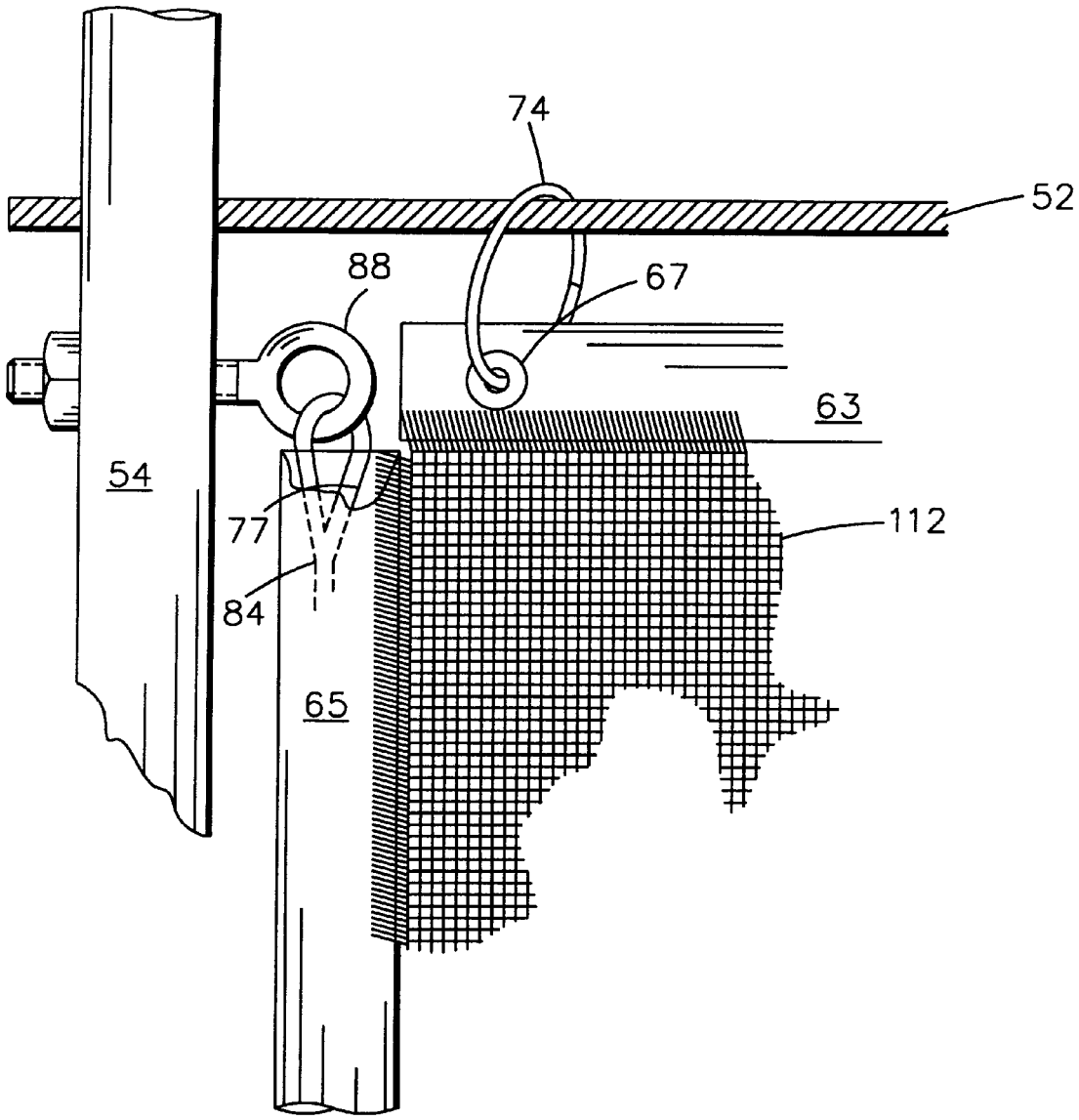
FIG. 12*b* illustrates a retractable fine mesh barrier using flexible borders and top border attached to cables with hooks.
Figure 13:
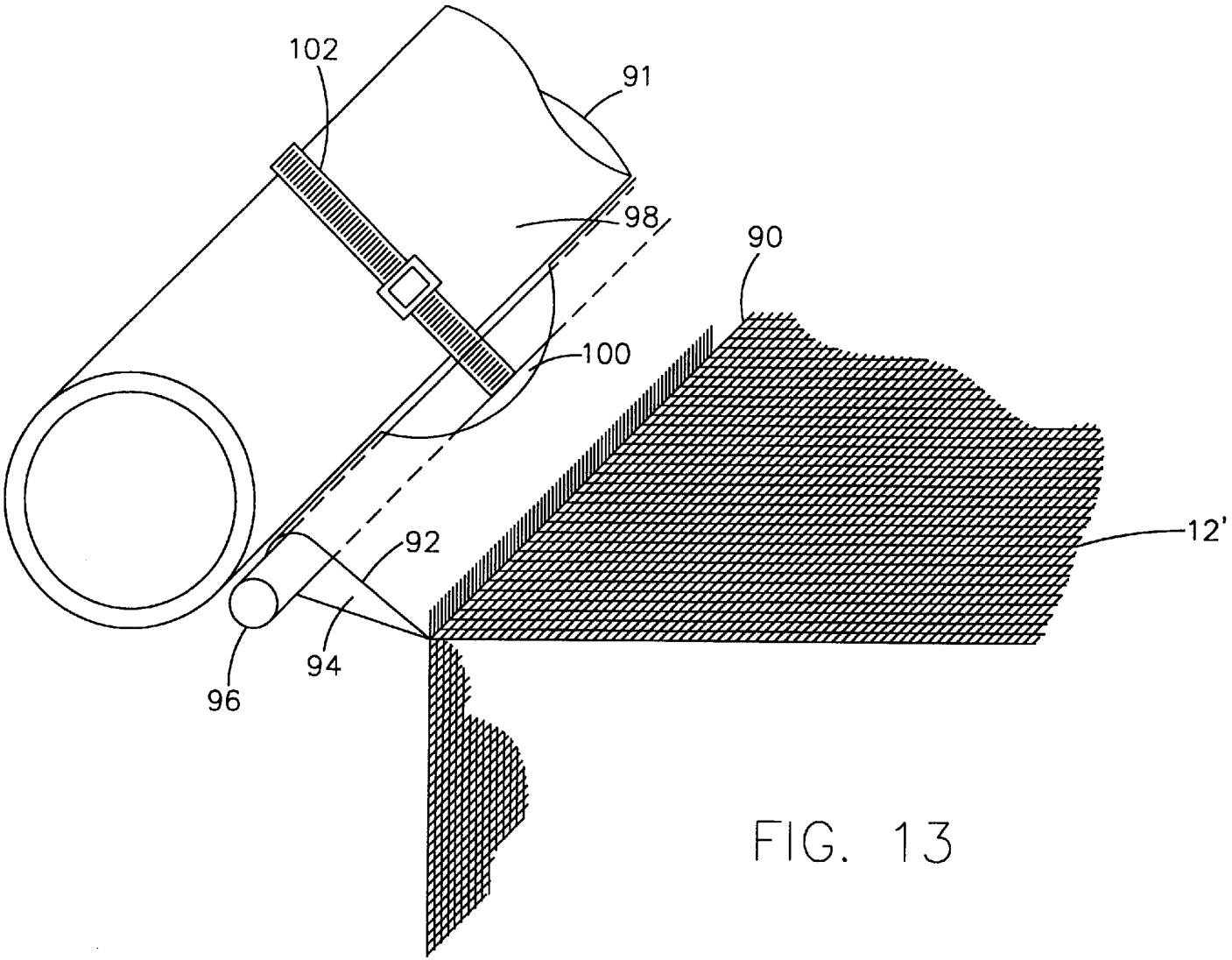
FIG. 13 is a perspective view of another support system.
Figure 15:
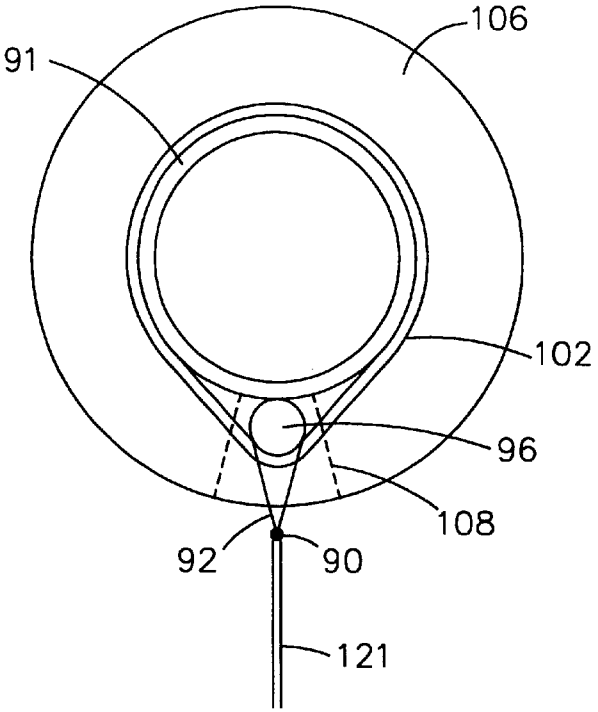
FIG. 15 is an end view of the support system of FIG. 13 with a single mesh panel.
Figure 14:
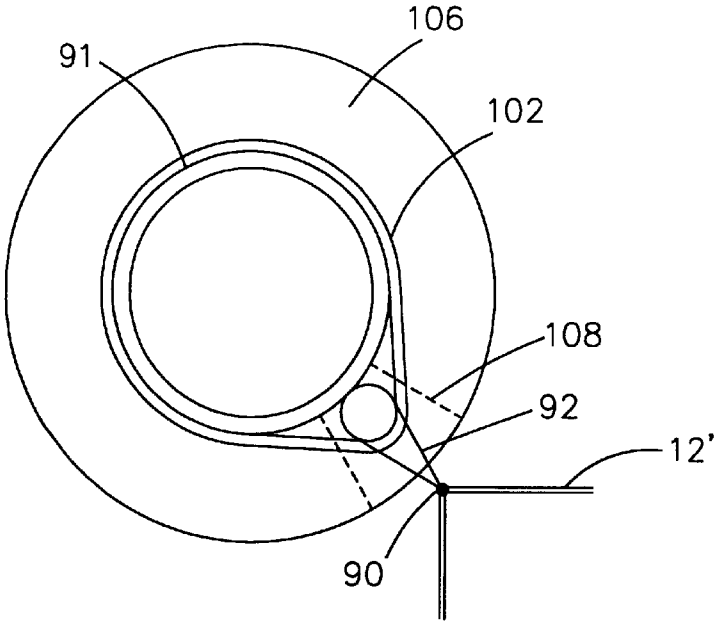
FIG. 14 is a vertical section view of the support system of FIG. 13 with a cushion disposed therearound.

Referring now to FIGS. 12*a* and 12*b,* it should be seen that the system shown therein includes mesh 112, 112' which can be comprised of any type of mesh structure with a border sewn or otherwise connected at orthogonally disposed edges of the mesh to define the illustrated borders 63 and 65. For purposes of illustration however, the mesh 112, 112' is shown in FIG. 12*a* as a mesh and in FIG. 12*b* as a improved viability and increased ventilation mesh. The horizontally disposed border 62 preferably includes at least one grommet 67 which may connect to a structural member 52 through the intermediary of a hook or ring of the type shown at 74 in FIG. 11. Alternatively, a mesh with a cord border as shown in FIG. 7 may be used with the hook or ring. A plurality of such connections can be made across the member 52 secured at given intervals along the border 62 so as to allow the mesh 112 to slide freely over the structural member 52. In this way, the mesh is movably retractable in the indicated direction AA. That is, prior art mesh, such a manufactured by TWITCHELL, P.O. BOX 8156 Dothan Ala. 36304, part #T69WKS012, while suitable for purposes other than discussed herein, is a material of leno weaves which is stiff and limited in flexibility making it hard to work with and incapable of folding or collapsing against itself in a curtain like manner, which in accordance with the invention can be either vertically or horizontally.

With respect to the lateral side edge of borders 65, it should be seen that each border 65 is a hollow pocket webbing which has an internal confine 77 through which a support cable or rope 84 is passed. An I-bolt 88 is also provided and is connected to the horizontally disposed member 54 to provide a securement point for the vertically disposed border 65. The rope may be double backed upon itself after passing through the I-ring as illustrated or can include a cable clamp at either end for locking engagement through the I-bolt 88 which is mounted to the structural member 52 to secure the lateral side edges of the mesh against movement. In this way, a barrier similar to a movable curtain can be created and implemented to allow access or prohibit access of certain areas of an environment.

Referring now to FIGS. 13–17, it should be seen that a system for connection to a structural member 91 according to the invention is disclosed. In this embodiment, the system for illustration purposes uses an improved viability and increased ventilation mesh 12' which is connected along sewn connection line 90 to a hollow border member 92 such that the mesh 12' forms a ninety degree angle with respect to the mesh panel connected by the line 90. Within the hollow confine 94 of the hollow border member 92 is a support rod or rope 96 which run coextensively within the border member 92.

The hollow border member 92 has a plurality of cutouts 98,98 formed therealong which extend inwardly enough to clear the diameter of the support rod 96 so as to provide a gap 100 through which is passed a plastic tie wrap 102 or lashing cord (not shown). The plastic tie wrap 102 is secured about a structural member 91. In this way, the border member 92 is oriented radially relative to the circular form of the member 91. This radial orientation of the border member 92 allows the mesh 12' to be spaced from the member so as to allow a circular cushion 106 with a radial slit 108 in it corresponding to the position of the border member 92 to be placed about the member so as to locate the connecting line 90 generally coincidentally with the outer surface of the cushion.

Figure 17B:
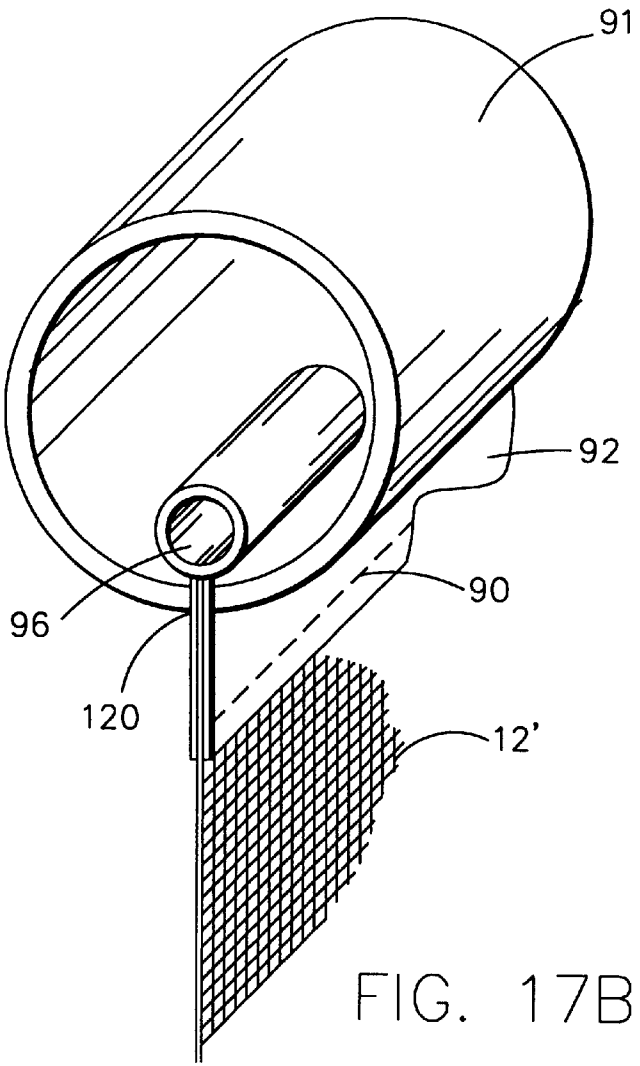
FIGS. 17*a* and 17*b* are fragmentary perspective views of an alternative connection.
Figure 17A:
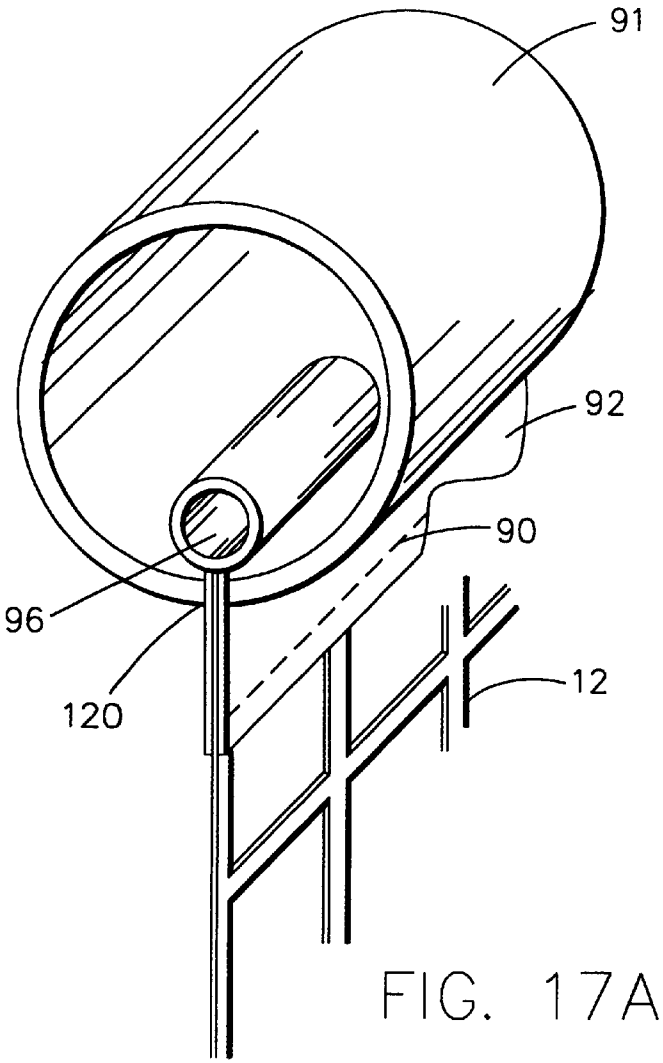

Referring to the alternate embodiment of FIGS. 17*a* and 17*b,* is should be seen that the member 91 has a longitudinal slit 120 which extends lengthwise therealong which is sufficiently wide to receive the width of the border 92 therein, but is to narrow enough to prohibit the member 96 from passing therethrough. Thus the mesh 12, 12' is held in place by the oversized diameter of the elongate member 96 to effect connection.

Figure 18:
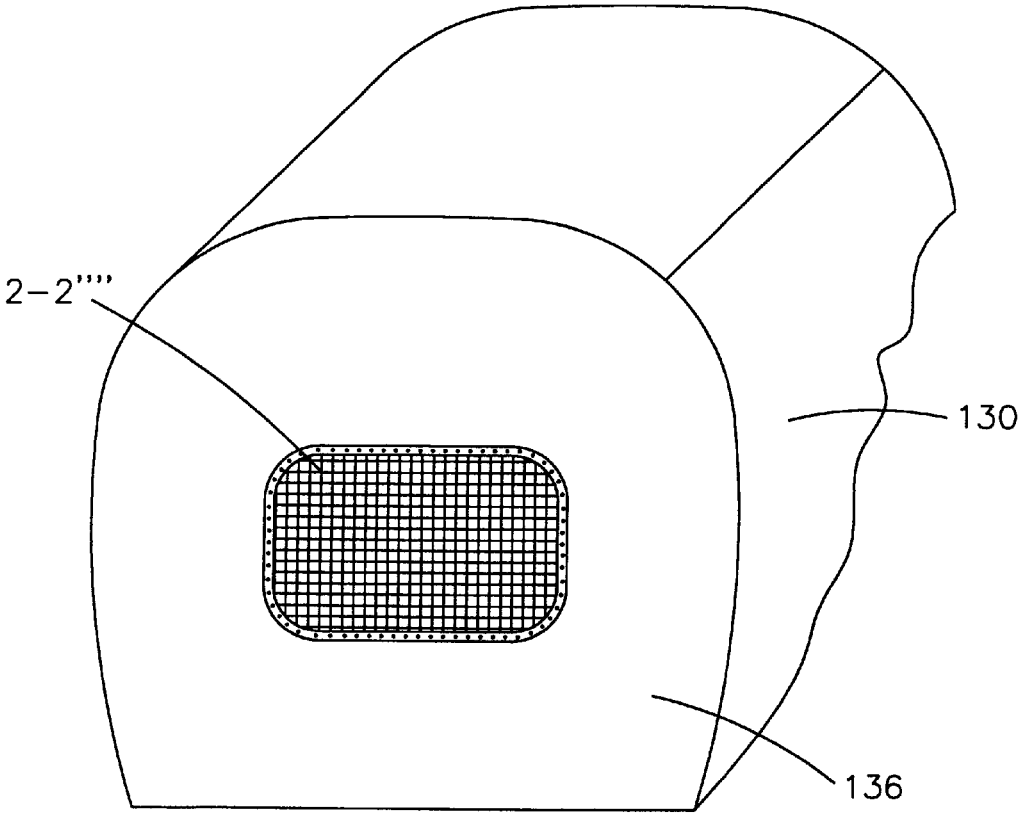
FIG. 18 is a partial perspective view of an inflatable unit with mesh secured to it for ventilation.
Figure 19:
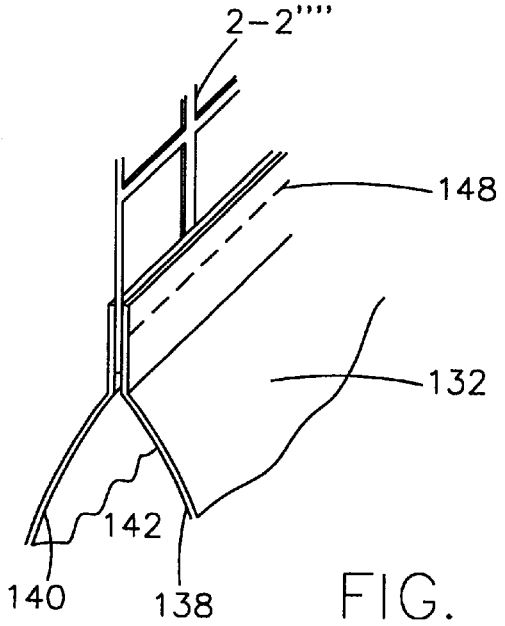
FIG. 19 is a partially fragmentary perspective view of a sewn connection between a jump unit connecting flap and fine mesh.
Figure 21:
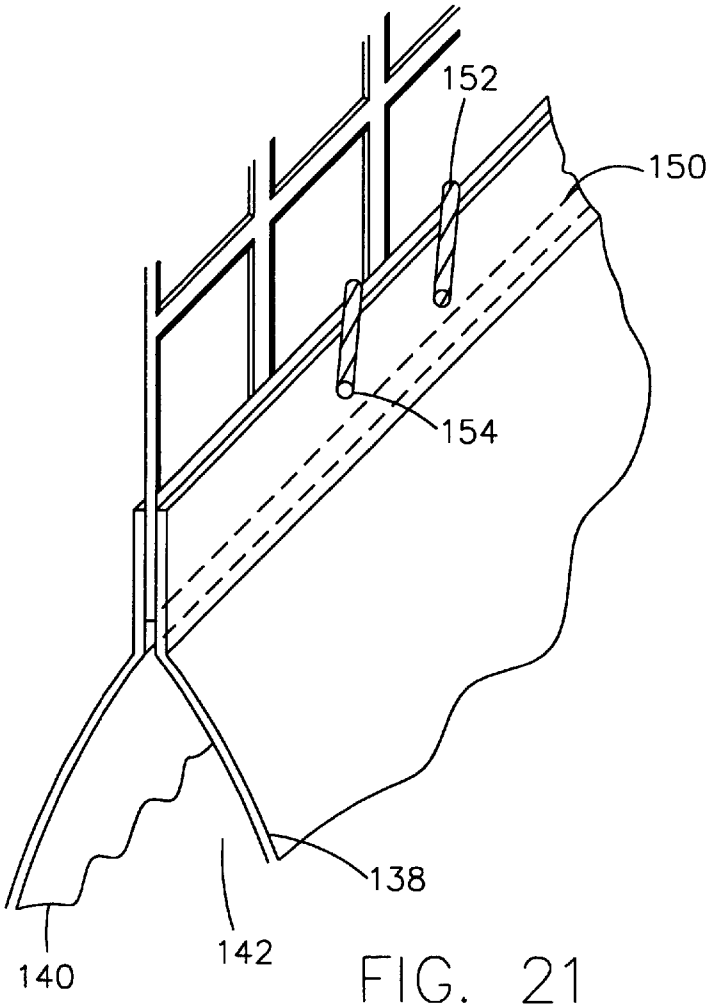
FIG. 21 is a partially fragmentary perspective view of a lashing connection between a jump unit connecting flap and fine mesh.
Figure 20:
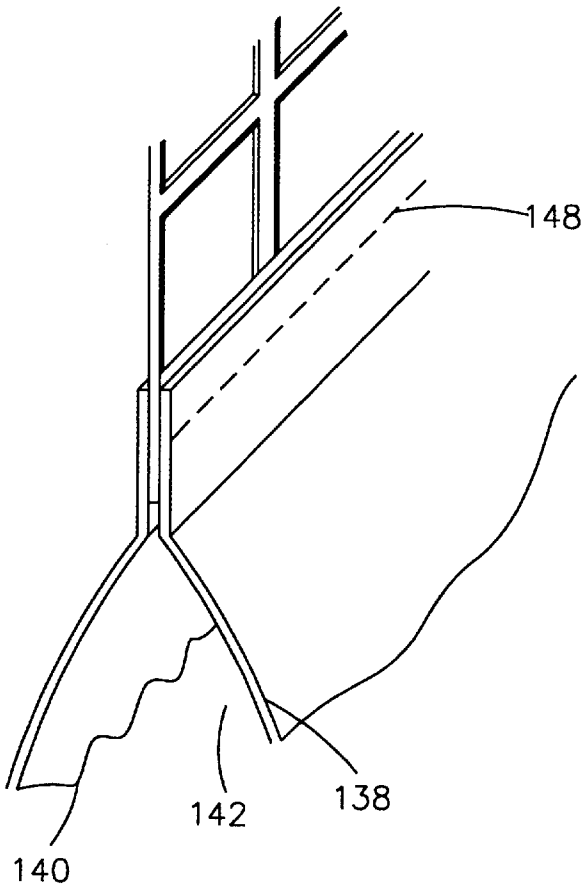
FIG. 20 is a partially fragmentary perspective view of a sewn connection between a jump unit connecting flap and a high visibility mesh.

Referring now to FIG. 18, a partial perspective view of an inflatable unit with mesh 2–2"" or 12, 12' secured to it for ventilation is shown and illustrated as 130. FIG. 19 illustrates a partially fragmentary perspective view of a sewn connection between a jump unit connecting flap 132 and fine mesh 2–2"". The flap 132 is part of a wall 136 which has inner and outer side plies 138 and 140 which contain the inflating air in chamber 142. In each of the embodiments of FIGS. 19 and 20, each of the plies 138 and 140 sandwich the mesh 2–2"" or 12, 12" with a stitched connection which is sewn completely through the three plies. In the embodiment of FIG. 21, the two plies are seamed together along line 150 either through a heat weld or through a line stitch and the mesh is connected to the plies via a lashing 152 which is passed through openings 154 in the seamed plies 138 and 140.

By the foregoing a flexible fine and/or course mesh which is easily installed, folded and retracted has been described by way of the preferred embodiments. Accordingly the invention has been described by way of the preferred illustration rather than limitation.

What is claimed is:

1. A method of forming a barrier partitioning one area from the other comprising the steps of:

providing at least one and another spaced apart structural members in an area for supporting a barrier mesh therein;

providing a mesh comprised of a plurality of closed shapes each comprised by a length of cord connected to a juxtaposed length of cord at given nodal points;

providing each said lengths of cord as a tightly woven lock mesh cord wherein said lock woven mesh cord is formed by weaving two pillars of cord locked together in side by side manner to form a panel having a given length and width;

providing an elongated member and attaching said elongated member to at least one of said length or width dimensions of said panel in order to secure said panel between said one and another structural members and securing said panel using said elongated member to said one and another structural members by causing said panel to be supported along at least one of said length or width dimensions to which said elongated member is attached;

forming said lock woven mesh in a diamond pattern and cutting said mesh diamond pattern in a diagonal fashion so as to create a square mesh pattern;

providing said elongate member as an upper pocket webbing and sewing the mesh at the leading edge thereof to the pocket webbing and inserting within the upper pocket webbing a support cable; and providing an angle connection between said one and another structural members and connecting at least one edge of said mesh panel to an associated structural member using a tie wrap.

2. A method as defined in claim 1 further characterized by providing said elongate member as a lower pocket webbing at the lower end of said mesh and securing it to said lower end of said mesh via a sewn stitch and inserting within said lower pocket webbing a weight or chain for pulling the mesh tautly between the support cable and the chain.

3. A method as defined in claim 1 further characterized by providing said pocket webbing with at least one grommet and supporting said mesh structure using said grommet.

4. A method as defined in claim 1 further characterized by using said mesh in a diamond configuration and threading a border rope through endmost ones of nodes defining said mesh and attaching at least one of said endmost nodes to said border rope using a flexible C ring fastener.

5. A method of forming a barrier partitioning one area from the other comprising the steps of:

providing at least one and another spaced apart structural members in an area for supporting a barrier mesh therein;

providing a mesh comprised of a plurality of closed shapes each comprised by a length of cord connected to a juxtaposed length of cord at given nodal points;

providing each said lengths of cord as a tightly woven lock mesh cord wherein said lock woven mesh cord is formed by weaving two pillars of cord locked together in side by side manner to form a panel having a given length and width;

providing an elongated member and attaching said elongated member to at least one of said length or width dimensions of said panel in order to secure said panel between said one and another structural members and securing said panel using said elongated member to said one and another structural members by causing said panel to be supported along at least one of said length or width dimensions to which said elongated member is attached;

forming said lock woven mesh in a diamond pattern and cutting said mesh diamond pattern in a diagonal fashion so as to create a square mesh pattern;

providing said elongate member as an upper pocket webbing and sewing the mesh at the leading edge thereof to the pocket webbing and inserting within the upper pocket webbing a support cable; and providing an angle connection between said one and another structural members and connecting at least one edge of said mesh to an associated one of said structural members using a lashing.

6. A method as defined in claim 5 further characterized by providing said elongate member as a border rope and connecting same to one of said one and another structural members via a locking hook or a doubled back length of said border rope.

7. A system for creating a slidable barrier in a setting comprising a structural member located generally in a plane with at least two spaced anchor points;

a mesh having one border member and a lateral border member;

said one border member having a plurality of hook rings which are passed through said one border member and connect to said structural member in a loop-like manner;

said lateral edge border having a means for securing same between said two spaced anchor points such that the lateral edges of said mesh are constrained against the movement and said one border can be retracted horizontally thereto.

8. A system as defined in claim 7 further characterized by said hook members being passed through grommets in the one border member and said lateral border member being a hollow pocket webbing through which a rope is passed and secures between the two anchor points disposed in vertical alignment with one another.

9. A system comprising:

a structural member;

a hollow border member;

a support rod disposed within said hollow border member;

a mesh having at least one panel with a connection line connecting said hollow border member to said mesh;

said border member having at least one cutout formed therein with forming a spacing between said support rod and the one edge of said at least one cut out;

and a securement means for connecting the support rod to said structural member, said securement means passing around said structural member and through said at least one cutout.

10. A window comprising:

a flap comprised of inner and outer side plies which contain an inflating air in chamber;

each of said plies being connected to one another along a line of connection;

a mesh connected to the flap generally adjacent said line of connection of said flap; and wherein said mesh is a flexible fine mesh material having intersecting elongate plastic yarns which form a grid-like pattern and said mesh is coated such that said mesh material is capable of being folded on itself in a fabric-like manner.

11. A window comprising:

a flap comprised of inner and outer side plies which contain an inflating air in chamber;

each of said plies being connected to one another along a line of connection;

a mesh connected to the flap generally adjacent said line of connection of said flap; and wherein said mesh is a woven mesh cord wherein said lock woven mesh cord is formed by weaving two pillars of cord locked together in side by side manner.

* * * * *